US010058479B2

(12) United States Patent
O'Dwyer et al.

(10) Patent No.: US 10,058,479 B2
(45) Date of Patent: Aug. 28, 2018

(54) CHILD RESISTANT BLISTER PACKAGE

(71) Applicant: WestRock MWV, LLC, Norcross, GA (US)

(72) Inventors: Gerry O'Dwyer, Dublin (IE); Steven P. Jones, Elon, NC (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

(21) Appl. No.: 15/293,417

(22) Filed: Oct. 14, 2016

(65) Prior Publication Data

US 2017/0112719 A1 Apr. 27, 2017

Related U.S. Application Data

(60) Provisional application No. 62/245,410, filed on Oct. 23, 2015.

(51) Int. Cl.

| | |
|---|---|
| ***A61J 1/03*** | (2006.01) |
| ***B65D 5/42*** | (2006.01) |
| ***B65D 75/36*** | (2006.01) |
| ***B65D 77/04*** | (2006.01) |
| ***B65D 83/04*** | (2006.01) |

(52) U.S. Cl.

CPC ..... *A61J 1/035* (2013.01); *B65D 5/4266* (2013.01); *B65D 75/367* (2013.01); *B65D 77/04* (2013.01); *B65D 83/0463* (2013.01); *B65D 2215/04* (2013.01)

(58) Field of Classification Search

CPC .... A61J 1/03; A61J 1/035; B65D 5/42; B65D 5/4266; B65D 75/36; B65D 75/367; B65D 77/04; B65D 83/04; B65D 83/0463; B65D 2215/04

USPC ..... 206/531, 532, 538, 539

See application file for complete search history.

(56) References Cited

U.S. PATENT DOCUMENTS

| | | | | |
|---|---|---|---|---|
| 7,201,274 | B2 * | 4/2007 | Paliotta | B65D 83/0463 206/531 |
| 7,401,702 | B2 | 7/2008 | Hession | |
| 8,011,512 | B2 * | 9/2011 | Brollier | A61J 1/035 206/531 |
| 8,091,708 | B2 * | 1/2012 | Loftin | A61J 1/035 206/531 |
| 8,607,982 | B2 * | 12/2013 | Jones | B65D 75/327 206/531 |
| 9,919,861 | B2 * | 3/2018 | Bolognia | B65D 83/0463 |
| 9,931,273 | B2 * | 4/2018 | Hammond | A61J 1/035 |
| 2007/0056876 | A1 | 3/2007 | Jones | |

(Continued)

FOREIGN PATENT DOCUMENTS

GB 2488865 A 9/2012

*Primary Examiner* — Bryon Gehman

(74) *Attorney, Agent, or Firm* — WestRock IP Legal

(57) ABSTRACT

A package includes a blank having a face panel and a back panel. The face panel includes apertures and face tabs. The back panel includes gates that correspond with apertures, and tab strips that overlap the gates and are adjoined to back tabs. A blister pack is sealed between the face panel and the back panel whereby blisters align over gates and protrude through apertures. To remove an item from a blister, a tab is pressed out of the panels, a pull tab is pulled to move a slidable tab clear from the gate, and pressure is applied to force the item through the backing sheet of the blister pack and the gate.

19 Claims, 10 Drawing Sheets

(56) References Cited

U.S. PATENT DOCUMENTS

| | | | | |
|---|---|---|---|---|
| 2009/0301924 | A1* | 12/2009 | Rondeau | B65D 83/0463 206/531 |
| 2016/0120745 | A1* | 5/2016 | Hammond | A61J 1/035 206/531 |
| 2016/0176617 | A1* | 6/2016 | Bolognia | A61J 1/035 206/534 |

* cited by examiner

102

CHILD RESISTANT BLISTER PACKAGE

REFERENCE TO RELATED APPLICATIONS

This application claims the benefit of priority under 35 U.S.C. § 119(e) of U.S. provisional application Ser. No. 62/245,410 filed on Oct. 23, 2015, which is hereby incorporated by reference in its entirety.

FIELD OF INVENTION

The present invention relates to apparatus and methods of packaging and dispensing items, and more specifically, the present invention is directed to a child-resistant package including a blister pack for dispensing items.

BACKGROUND OF THE INVENTION

It is well known to use blister packaging to contain items. Such items may include pharmaceutical tablets, pills, and capsules. Conventional blister packages include a blister tray that is typically a thermo-formed plastic sheet having a plurality of blister cells or depressions formed therein. Typically, after the items are placed in the cells, the items are retained and protected in the cell by securing a backing sheet comprising foil, plastic or a paperboard lid that covers the blister cells. In other types of conventional packages the contents are placed in substantially puncture proof foil containers that are then covered with a foil or paperboard lid.

In conventional packages, the foil is thin enough to be either punctured mechanically or ruptured by pressing the enclosed items against the foil. Typically with paperboard lids, gates are formed in the lid in the general vicinity of the blister cells to assist with removing the contents from the cells. Each gate is deformed or manipulated so that it ruptures or partially separates from the paperboard lid, allowing the item within the blister cell to be pushed through the gate.

While the conventional blister packages are suitable for some applications, there are several design deficiencies. The conventional blister packages provide removal of the items from the blister cells, but offer very little child resistance. Child resistance is a feature that is particularly desired for unit dose pharmaceutical packaging, and is mandated by the Poison Prevention Packaging Act of 1970. Guidelines are prescribed for packaging to satisfy the criteria for child resistance. For example, a child-resistance (CR) rating of F=1 requires that a random sampling of the subject packages not be compromised by an age-specific test pool of children at no greater than a predetermined failure rate. This general guideline is designed to ensure that the package has sufficient integrity against tampering by children.

In addition to a blister package being child-resistant, it is also desirable that the package be senior friendly to permit easy withdrawal of items from the package requiring minimum manipulation even where a user's manual dexterity and strength is reduced.

One example of a child-resistant unit dose package is disclosed in commonly-assigned U.S. Pat. No. 7,401,702, issued Jul. 22, 2008, and titled "Child-resistant blister package", which is hereby incorporated by reference in its entirety.

There still remain in the art a need for additional apparatus and methods of packaging and dispensing items where the package is senior friendly and substantially child-resistant.

SUMMARY OF THE INVENTION

The present invention overcomes the deficiencies of the known art and the problems that remain unsolved by providing a child-resistant package that is inexpensive, easy to fabricate and can be used with conventional blister packs. Generally speaking, the child-resistant package includes a blister pack that is disposed and sealed between two panels. The package includes a tab strip that is associated with a pull tab where the tab strip covers a gate. The tab strip is sandwiched between the two panels. The gate correspondingly aligns with each blister of a blister pack to additionally secure at least one item within the blister. Pressure is applied to the pull tab to bend the pull tab outwards. The pull tab is pulled to slidably remove the tab strip from between the panels in order to expose the gate. Finally, pressure is applied to the corresponding blister to force an item to rupture the backing sheet of the blister pack and to gain access to an item. The child-resistant package of the present invention includes security features that require a sequence of coordinated motions including pressing, pulling, and pressing again to gain access to a limited number of items.

In accordance with an exemplary embodiment of the present invention, there is provided a packaging system comprising at least one panel including at least one gate; at least one panel tab and one aperture alignably formed on said panel, on a side opposite from said gate, wherein said aperture corresponds with said gate; at least one tab strip having a strip tab, said tab strip overlapping said gate; a blister pack including at least one blister for holding at least one item, said blister pack being disposed on said panel so that said at least one blister aligns with said gate, and wherein said panel is folded to seal said blister pack, said at least one blister extending through said aperture and said tabs being attached together.

In additional exemplary embodiments of the present invention, there are provided methods of packaging items within a package. One method comprises the steps of: constructing a packaging blank comprising; a face panel including, a face blank, at least one face tab, and at least one aperture corresponding to said face tab; a back panel including, a back blank, at least one gate oppositely aligned with said aperture, and at least one tab strip having a back tab oppositely aligned with said face tab, said tab strip overlapping said gate. Positioning a blister pack on the back panel, said blister pack including a plurality of blisters for holding at least one item, said at least one blister aligning over said gate, and folding said packaging blank for sealing said blister pack between said face panel and said back panel where said at least one blister extends through said aperture, said tabs being sealed together forming a pull tab where said blanks are sealed together forming a cover.

Regarding the embodiments described herein, as well as those covered by the claims, the face panel and back panel may or may not include a tear-resistant layer to provide structural integrity and reinforcement to the child-resistant package. Further, alternative embodiments may include adhesive as a means to permit or control separation and/or delamination of the panel and thus access to the stored item. In addition, the blister pack may or may not comprise a conventional blister pack including at least one blister for holding at least one item. The blister pack may be designed to include any shape or dimension that corresponds with a packaging blank. Further, the terms, "face" and "back" are merely directional in order to distinguish one surface from another. Accordingly, those terms are not limitations but may be used interchangeably. In addition, although full and partial cuts are described herein, it is contemplated that these cuts include perforations comprising a line of short slits, a line of half cuts, a single half cut, and any combination of slits, score lines, and half cuts, or the equivalent, as understood by those skilled in the art.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention. It will be understood that the present invention is applicable to the packaging, storing, and dispensing of various items or products, including but not limited to, tablets, pills, capsules, lozenges, chewables, patches, drug delivery devices, medications, and/or non-medications, liquids and the like. The term "items" as used herein include a unit dose of a pharmaceutical product and all manner of small and portable items or products that a user may wish to keep secure and dispense in a regulated, safe manner.

Figure 1:
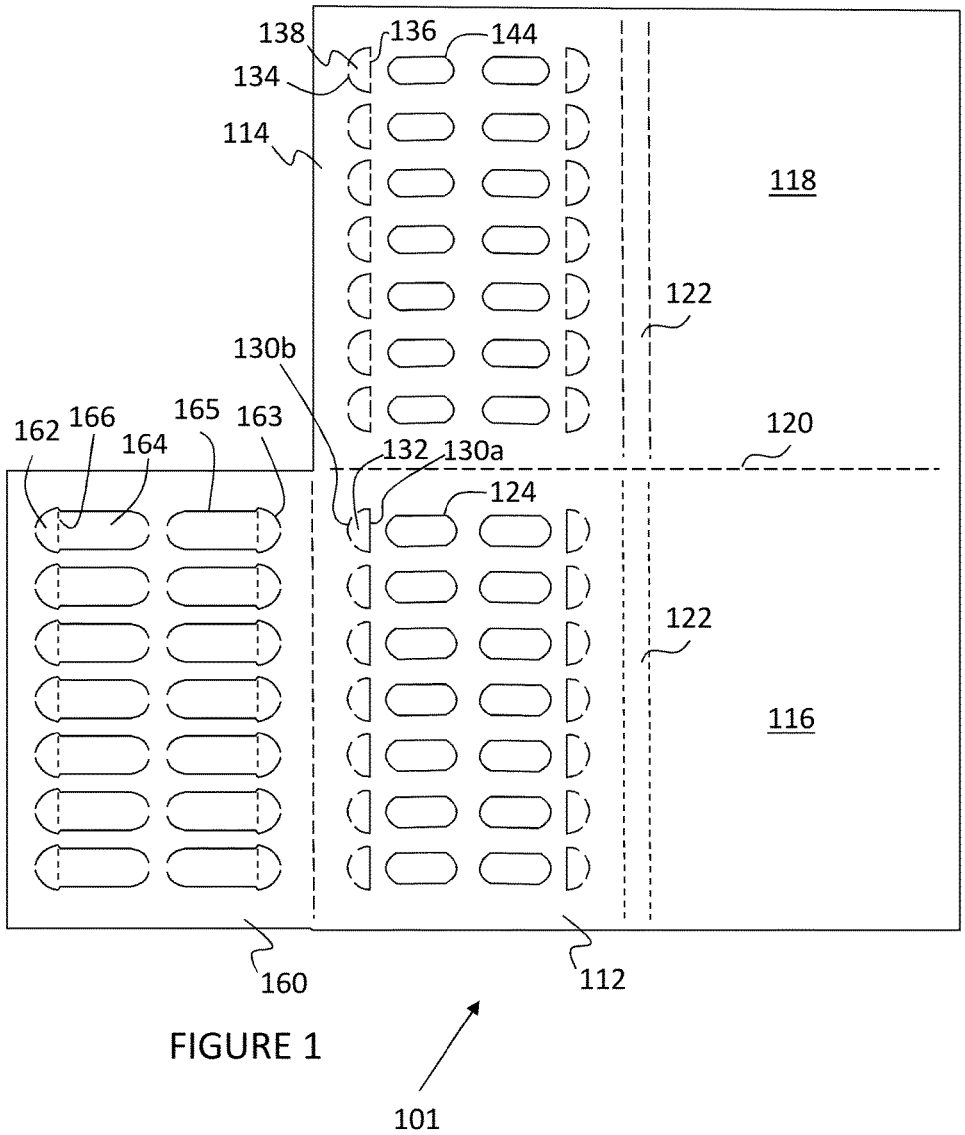
FIG. 1 is a plan view of an inner surface of an exemplary packaging blank, according to the present invention.

Referring now to the drawings, wherein like elements are represented by like numerals, FIG. 1 shows a plan view of an exemplary packaging blank 101, from an interior surface thereof, according to the present invention. The packaging blank 101 is illustrated having a face panel 112 that is integrally hinged with a back panel 114 at foldable score line 120. Although in an exemplary embodiment the face panel 112 and back panel 114 are integrally formed as one piece, it will be understood that the face panel 112 may be separate and distinct from back panel 114. A first cover panel 116 may be hingedly attached to face panel 112 through a spine panel 122. A second cover panel 118 may be hingedly attached to back panel 114 through a spine panel 122.

The packaging blank 101 can be selected from any suitable substrate material, or combination thereof, to include plastics and conventional paperboard grades, for example solid bleached sulfate (SBS) paperboard ranging in weight, size, and shape. The blank 101 may also be an unbleached board, depending on the desired appearance of the final package. The substrate, if paperboard, is preferably coated on at least one side, with a conventional coating selected for compatibility with the printing method and board composition. The package blank 101 is typically formed so that after folding, the coated side (the outer surface opposite from that shown in FIG. 1) becomes the external surface of the package. This allows information or directives about the package contents to be viewed without opening the package. For purposes of teaching and directional orientation only, the illustrated embodiments comprise an unprinted side (the inner surface) and a printed side (the outer surface). The unprinted side, that is, the inner surface, is visible in FIGS. 1-3, while the opposite, outer surface, is the printed side shown in FIG. 4.

Figure 2:
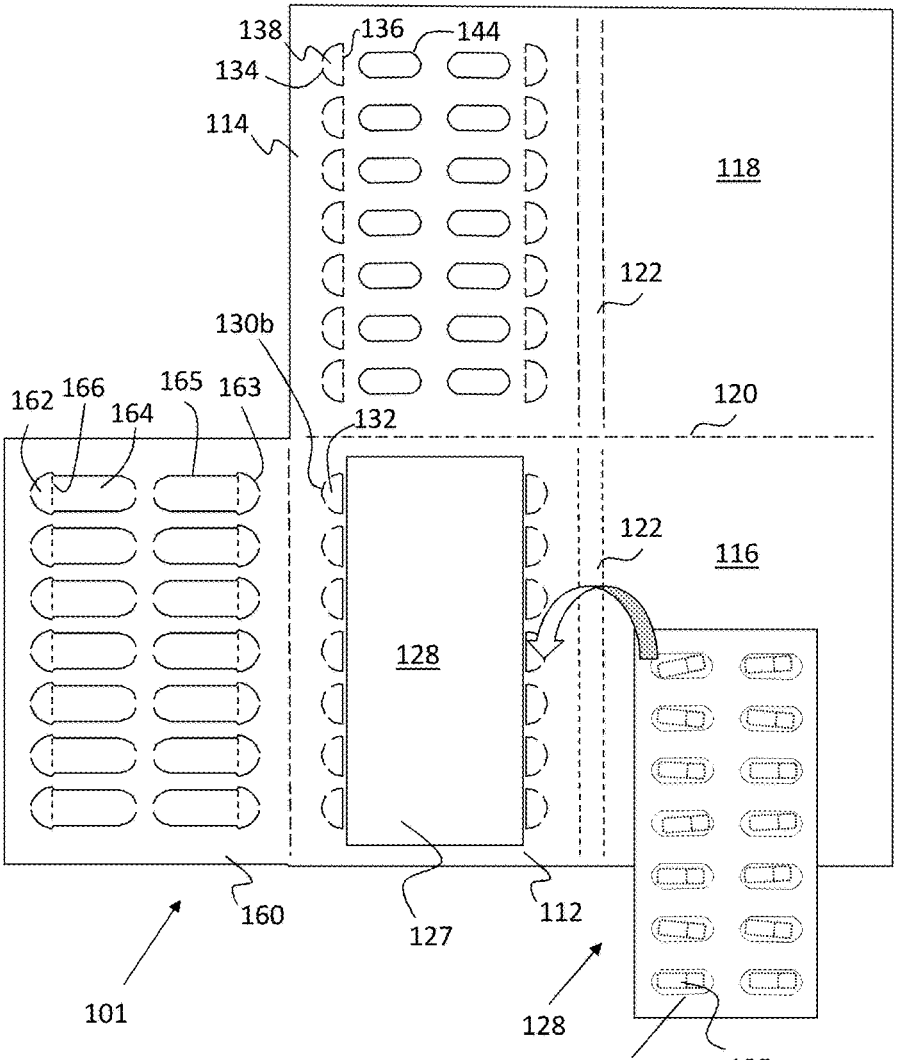
FIG. 2 is a plan view of the inner surface of the blank of FIG. 1, with a blister pack placed in registry with one of the panels.

As illustrated in FIG. 1, the face panel 112 includes a plurality of apertures 124 dimensioned and aligned to receive and fit around a corresponding blister 126 of a blister pack 128, best illustrated in FIG. 2. The apertures 124 are dimensionally designed to correspond with the shape and size of blisters 126. The face panel 112 further contains a series of full-depth cuts 130*a*, 130*b* forming a perforated or serrated line, or other frangible or weakened line of severance. Within the scope of the invention, the cuts 130*a*, 130*b* may also be full, single-cut lines. The cuts 130*a*, 130*b* can vary in shape and size, as needed, to form removable face tabs 132. It will be noted that the apertures 124 and face tabs 132 may comprise any layout, size, shape, number and/or dimensions without departing from the scope of the invention.

The inner surface of the back panel 114 includes a series of full-depth cuts 134 forming a perforated or serrated line, or other frangible or weakened line of severance. Partial-depth cuts forming a perforated or serrated line, or other frangible or weakened line of severance, or creases or scores of predetermined depth define a line 136, which together with full-depth cuts 134 form removable back tabs 138. Both cuts and/or lines 134, 136 may be die-cut from the inner surface (unprinted side). The back tabs 138 correspondingly align with the face tabs 132 on face panel 112.

The inner surface of the back panel 114 further includes a plurality of gates 144 that correspondingly align with each aperture 124 on face panel 112. Gates 144 may be die-cut openings through back panel 114. As can be comprehended from FIG. 2, each individual gate 144 aligns with each corresponding blister 126 and overlaps the backing sheet or lidding film 127 of the blister pack 128 to additionally secure item 125 within blister 126.

An auxiliary panel 160 is hingedly connected to face panel 112. The auxiliary panel 160 has formed therein slide tabs 164 that include slide pulls 162. The slide tabs may be formed by partial or full depth cuts or perforations 165. The slide pulls 162 may be formed by partial or full depth cuts or perforations 163. The slide pulls 162 may be hingedly attached to the slide tabs 164 through hinge lines 166.

FIG. 2 shows a blister pack 128 with blisters 126 housing items 125. The blister pack 128 is flipped over onto face panel 112 so that blisters 126 fit into apertures 124 in face panel 112. As shown in FIG. 2, the surface of blister pack 128 opposite from the blisters 126 may be a lidding film 127 such as aluminum foil.

Figure 3:
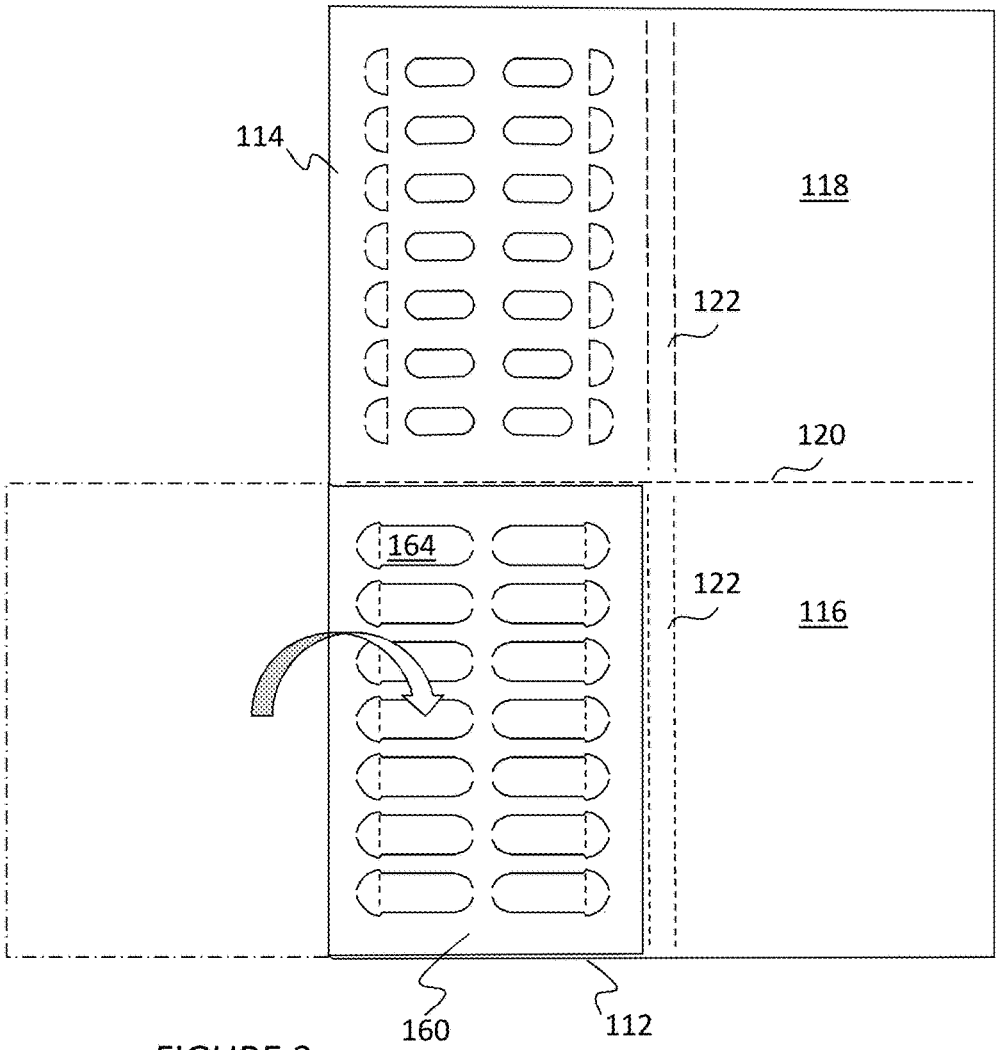
FIG. 3 is a plan view of the blank of FIG. 2, with an internal panel containing slide tabs having been folded over onto the blister pack.

FIG. 3 shows the auxiliary panel 160 being folded over onto the face panel 112 with the blister pack 128 captured between. The slide tabs 164 may overlap and align with the blisters 126 of the blister pack 128.

Figure 4:
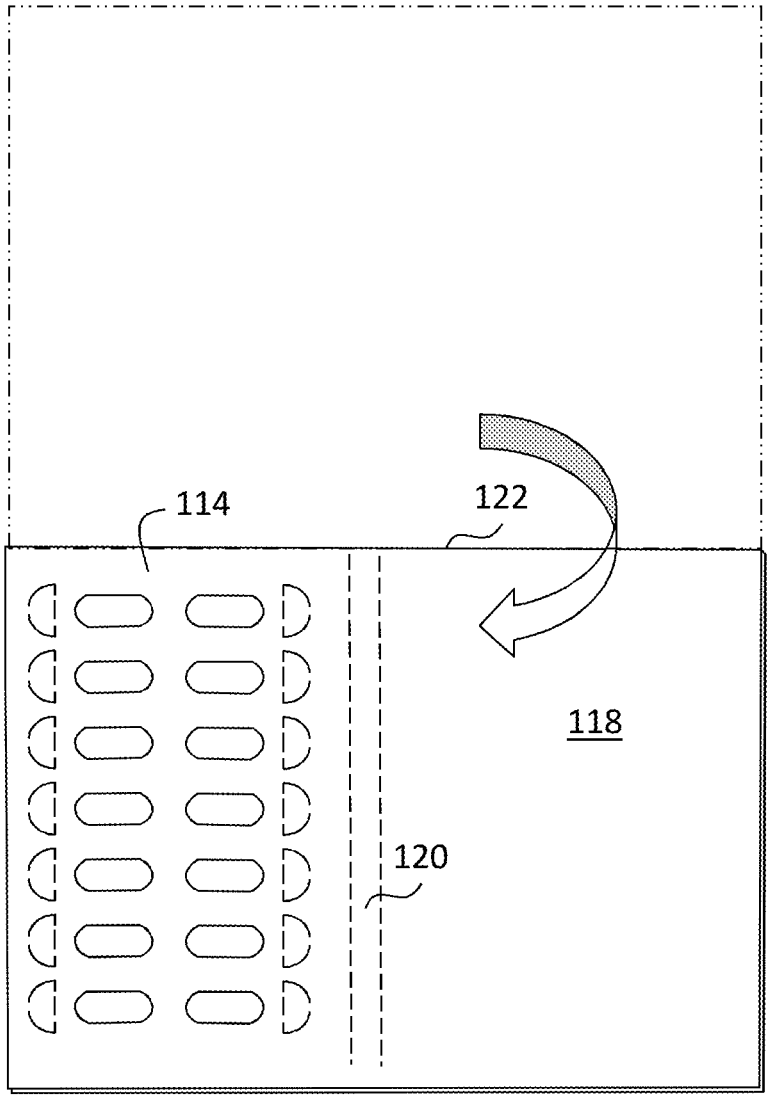
FIG. 4 is a plan view of the blank of FIG. 3 with outer panels folded over onto the other panels and blister pack.

FIG. 4 shows the back panel 114 folded over with respect to face panel 112 (with the auxiliary panel 160 and blister pack 128 sandwiched between). The back panel 114 and face panel 112 may be attached together by adhesive, heat sealing, or any desired method. Such attachment may be made while leaving the slide tabs 164 not directly adhered to any of the back panel 114, face panel 112, or blister pack 128. It will be understood that the face panel 112, back panel 114, auxiliary panel 160 and blister pack 128 (or portions thereof) may be sealed by any means known in the art, including but not limited to, an Easy Seal® or Easy Seal® Plus product. It should also be understood that with the back panel 114 and face panel 112 folded together, with the blister pack 128 and auxiliary panel 160 between the back panel 114 and face panel 112, each blister 126, aperture 124, slide tab 164, and gate 144 will be in registry with one another.

Figure 5:
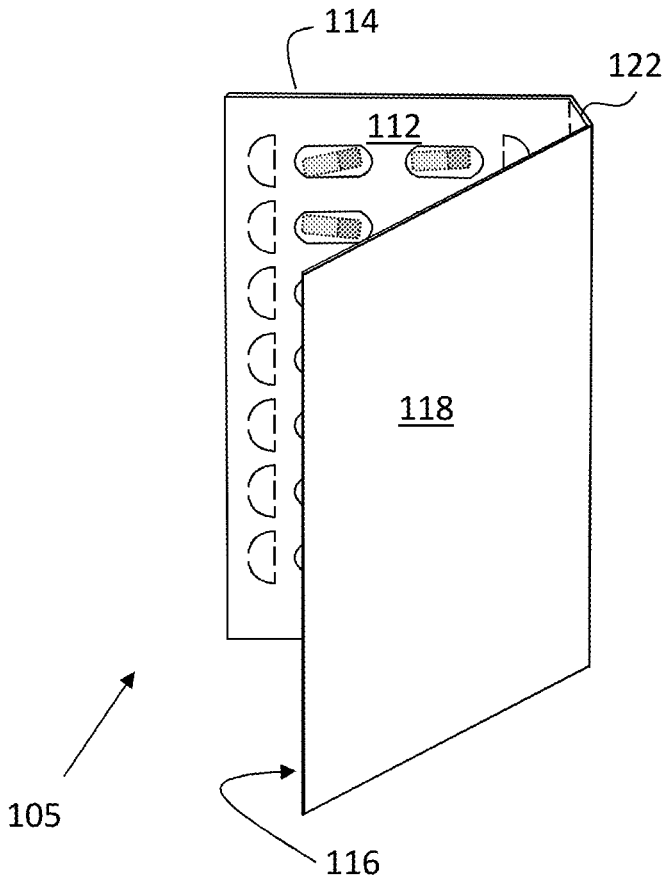
FIG. 5 is a perspective view of the resulting package, folded to form a book-like structure.

FIG. 5 shows the package 105 formed when the structure of FIG. 4 is folded along spine panels 122. Face panel 112 and back panel 114 are shown in the background where they form a multi-layer structure (including the blister pack and auxiliary panel) while first cover panel 116 and second cover panel 118 form a two-ply cover in the foreground.

Figure 6A:
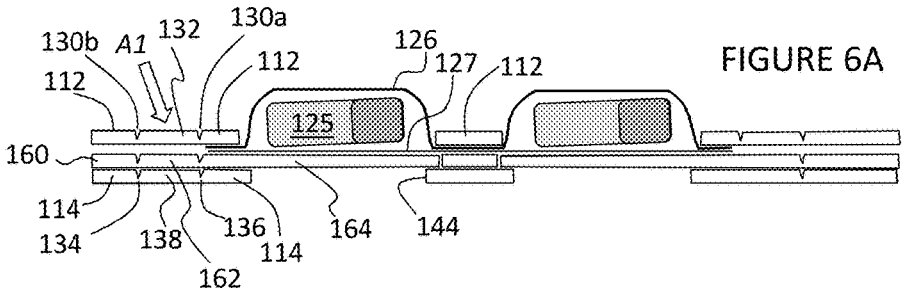
FIG. 6A is a cross section of the package of FIG. 5, showing blisters and slide tabs.

FIG. 6A shows a cross section view through the face panel 112, auxiliary panel 160, and back panel 114, in the vicinity of a blister 126. As shown in FIG. 6A, the combined lidding film 127 and slide tab 164 provide substantial resistance against expressing the content item 125 from the blister 126. The resistance may be at least sufficient to prevent a child from forcing the content item from the blister.

To open a blister, pressure may first be applied to face tab 132 as denoted by arrow A1. This may break face tab 132 free from any connection to face panel 112 through lines 130*a*, 132*b*.

Figure 6B:
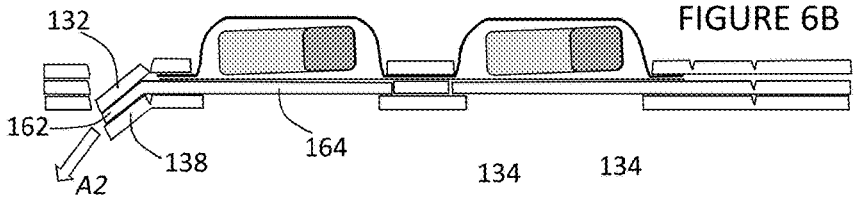
FIG. 6B is a cross section of the package showing a slide tab being pushed into a position where it may be pulled loose.

As shown in FIG. 6B, the downward pressure on face tab 132 may also break loose slide pull 162 from any connection to the auxiliary panel 160, and may break loose back tab 138 from any connection to the back panel 114. The combined layers of face tab 132, slide pull 162, and back tab 138 may be pulled outward as shown by arrow A2.

Figure 6C:
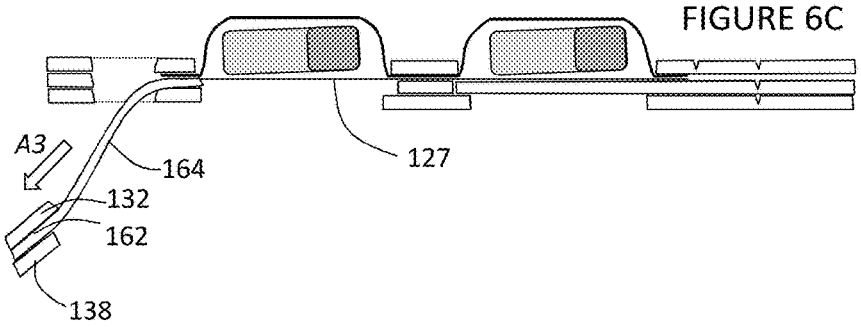
FIG. 6C is a cross section of the package showing the slide tab pulled loose from the package.

As shown in FIG. 6C, continued pulling (arrow A3) on the slide pull 162 draws slide tab 164 out from under its associated blister 126. The item 125 within blister 126 is now held only by lidding film 127. The resistance of the lidding film alone may be low enough that the content item 125 may now be more easily expressed from the blister 126.

Figure 6D:
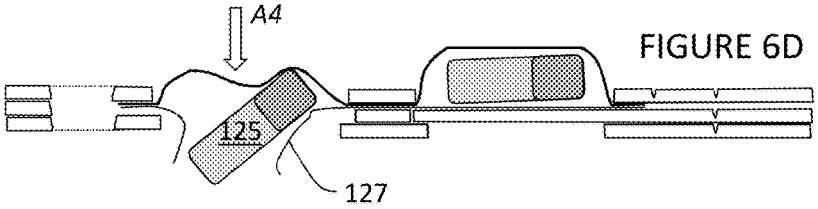
FIG. 6D is a cross section of the package showing the blister contents being expelled through an opening left after removal of the slide card.

As shown in FIG. 6D, pressure A4 on the blister 126 will force its content item 125 downward and through lidding film 127.

Figure 7:
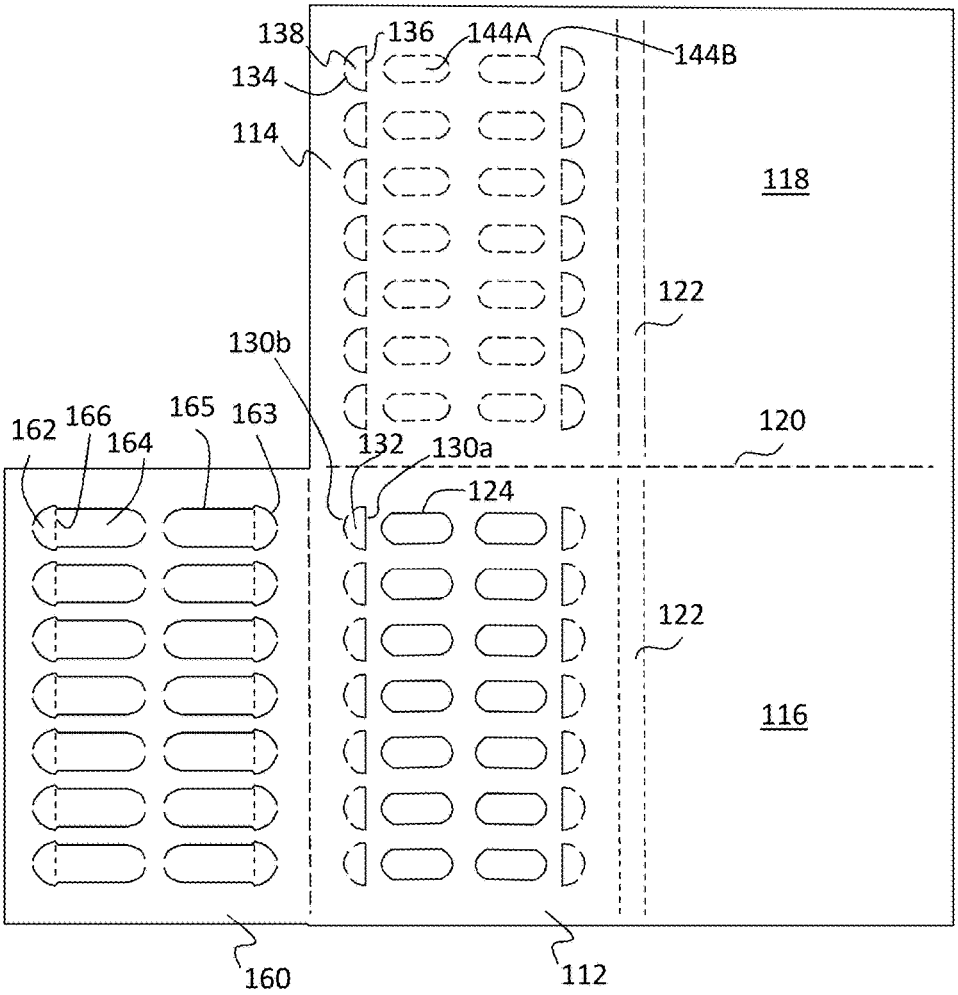
FIG. 7 is a plan view of an inner surface of another exemplary packaging blank, according to the present invention.

FIG. 7 shows a plan view of another exemplary packaging blank 102, from an interior surface thereof, according to the present invention. The various features are similar to blank 101, and only the differences will be described now.

The inner surface of the back panel 114 further includes a plurality of back gates 144 that correspondingly align with each aperture 124 on face panel 112. In contrast to the openings 144 in FIG. 2, the back gates 144A shown in FIG. 7 may be (temporarily) closed back gates defined and formed by partial-depth cuts 144B which are die cut on the unprinted side of the back panel 114. This may add another layer of security to the package. The cuts 144B may be designed to require a desired amount of force to break loose the back gates. As explained previously, each individual gate 144A aligns with each corresponding blister 126 and overlaps the lidding film 127 of the blister pack 128 to additionally secure item 125 within blister 126.

Figure 8A:
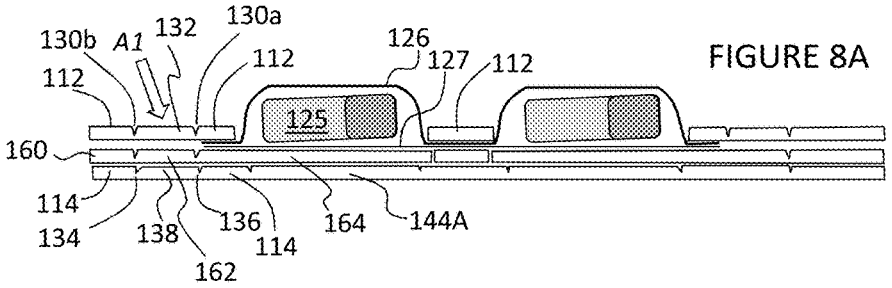
FIG. 8A is a cross section of a package formed from the blank of FIG. 7, showing blisters and slide tabs.

FIGS. 8A-8D are similar in most aspects to FIGS. 6A-6D, but show the added presence of back gates 144A instead of the openings 144 in the earlier Figures. FIG. 8A shows a cross section view through the face panel 112, auxiliary panel 160, and back panel 114, in the vicinity of a blister 126. To open a blister, pressure may first be applied to face tab 132 as denoted by arrow A1. This may break face tab 132 free from any connection to face panel 112 through lines 130*a*, 132*b*.

Figure 8B:
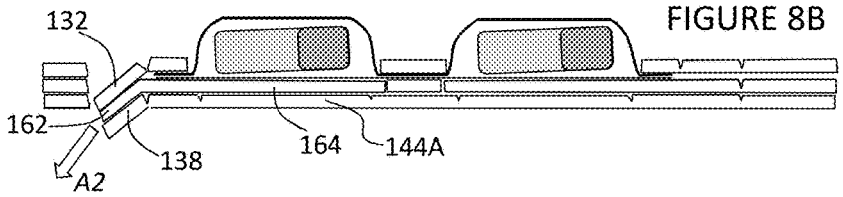
FIG. 8B is a cross section of the package showing a slide tab being pushed into a position where it may be pulled loose.

As shown in FIG. 8B, the downward pressure on face tab 132 may also break loose slide pull 162 from any connection to the auxiliary panel 160, and may break loose back tab 138 from any connection to the back panel 114. The combined layers of face tab 132, slide pull 162, and back tab 138 may be pulled outward as shown by arrow A2.

Figure 8C:
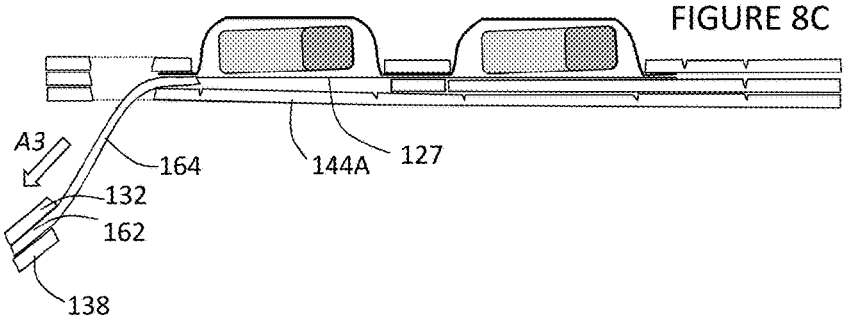
FIG. 8C is a cross section of the package showing the slide tab pulled loose from the package.

As shown in FIG. 8C, continued pulling (arrow A3) on the slide pull 162 draws slide tab 164 out from under its associated blister 126. The item 125 within blister 126 is now held by lidding film 127 but additionally by back gate 144A.

Figure 8D:
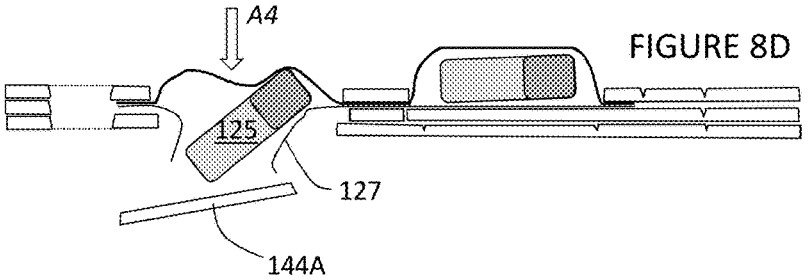
FIG. 8D is a cross section of the package showing the blister contents being expelled through an opening left after removal of the slide card.

As shown in FIG. 8D, pressure A4 on the blister 126 will force its content item 125 downward and through lidding film 127, also breaking loose back gate 144A from back panel 114.

Figure 9:
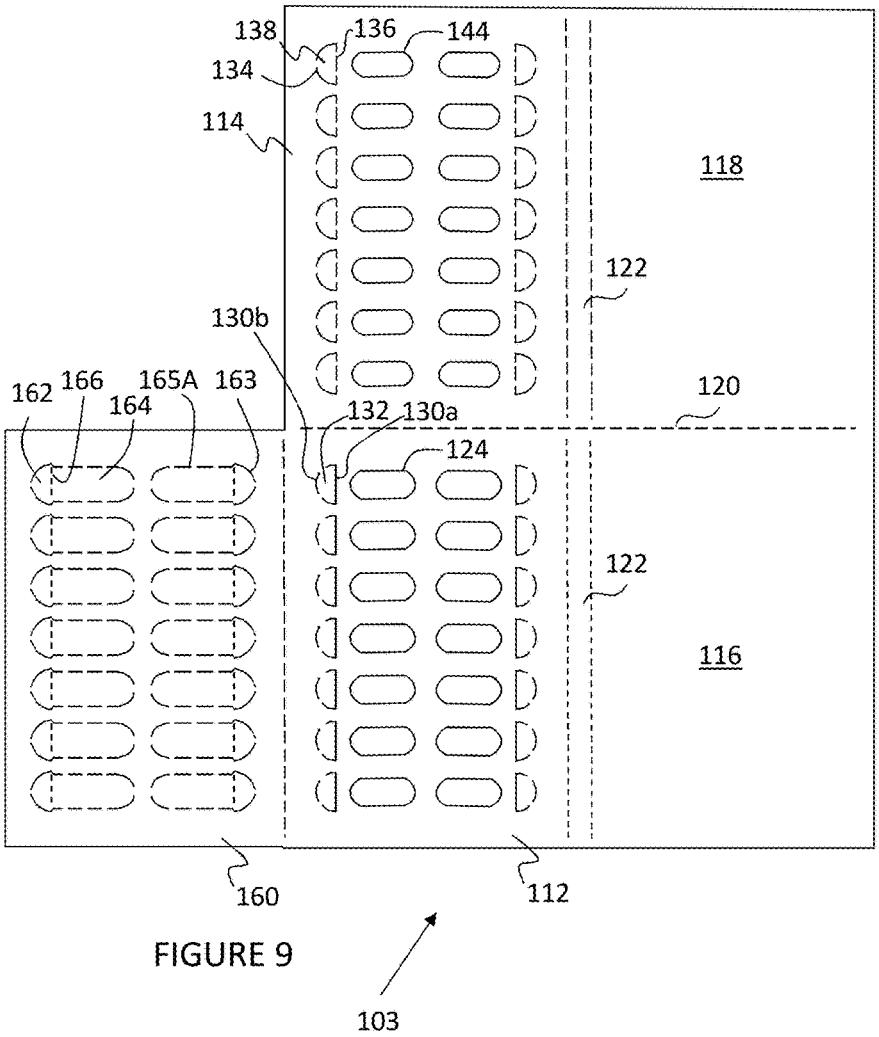
FIG. 9 is a plan view of an inner surface of another exemplary packaging blank, according to the present invention.

FIG. 9 shows a plan view of another exemplary packaging blank 103, from an interior surface thereof, according to the present invention. The various features are similar to blank 101, and only the differences will be described now. In blank 103, the slide tabs may be formed by partial or full depth cuts or perforations 165A which may include one or more nicks (uncut areas) to provide a degree of initial resistance to the slide tabs being slid out of the package. The degree of resistance may be controlled by the number and size of the nicks.

Figure 10:
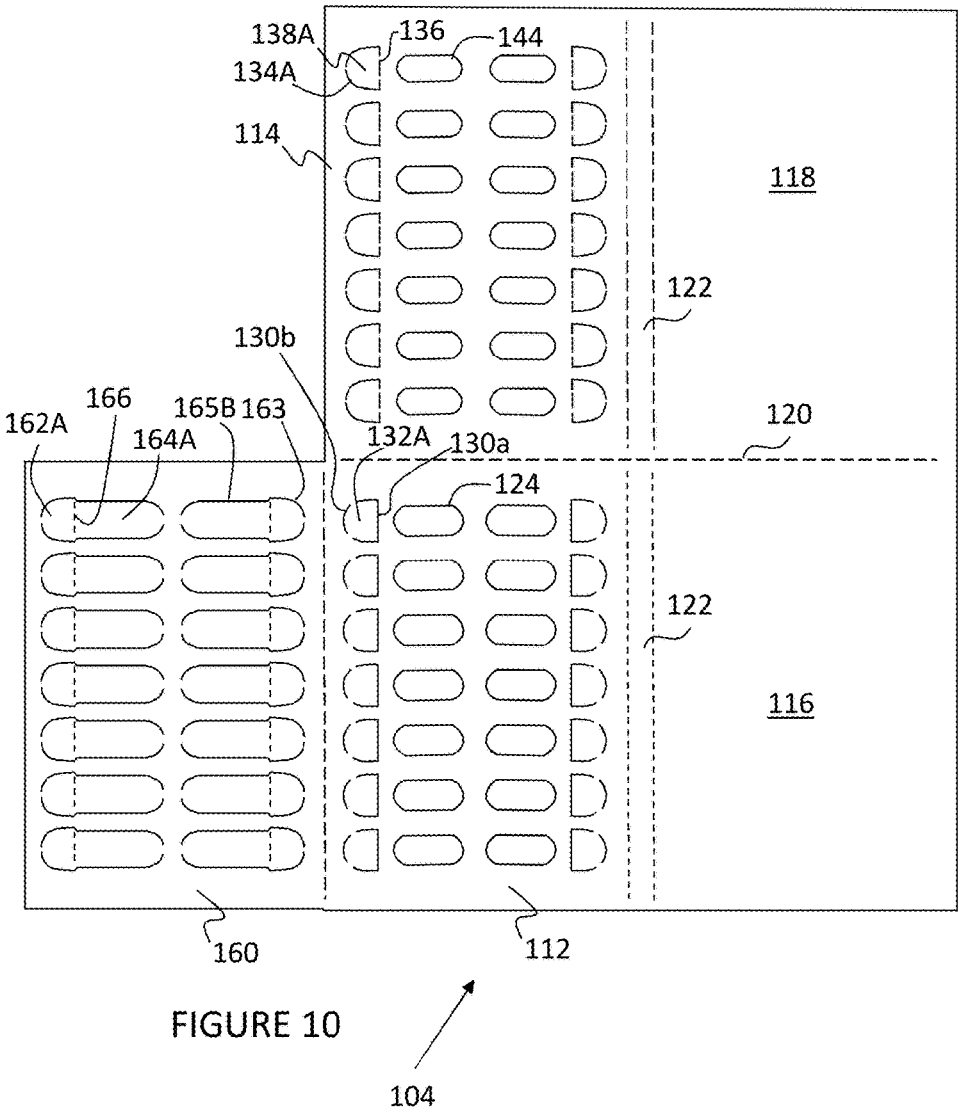
FIG. 10 is a plan view of an inner surface of another exemplary packaging blank, according to the present invention.

FIG. 10 shows a plan view of another exemplary packaging blank 104, from an interior surface thereof, according to the present invention. The various features are similar to blank 101, and only the differences will be described now. In blank 104, slide tabs 164A defined by cut or perforation lines 165B may be made larger than the slide tabs 164 in blank 101. This may help resist undesired pushing of the slide tabs through back gates 144. Slide pulls 162A (as well as face tabs 132A, and back tabs 138A defined by lines 134A) may also be made larger to make them easier for a user to grasp.

A tear-resistant layer may or may not be adhered to packaging blanks 101, 102, 103, 104. A tear-resistant layer may be attached to the unprinted side of face panel 112. Tear-resistant layers are often laminated to the blank before cutting. Some examples of acceptable laminates include Endurance PTHS® and EZ Seal®, both of which are presently available through the Applicant. The tear-resistant layer provides structural integrity in sealing blister pack 128 between face panel 112 and back panel 114. A tear-resistant layer can also be disposed over the lidding film 127 of the blister pack 128 to overlie blisters 126 to provide additional child-resistant security features.

One embodiment of a method of manufacturing the above described blanks 101, 102, 103, 104 comprises the cuts being made in one or more passes. In one pass, with the unprinted side (or inner surface) facing a knife or die, partial-depth cuts are made. Alternative embodiments may substitute a partial-depth cut with a crease, score, or similar foldable line. In another pass, or in the same pass but with regard to the printed side facing a knife or die, partial-depth cuts are made. Full-depth cuts of course may be made from either side.

The blister pack 128 includes a plurality of blisters 126 that may be arranged in a variety of layouts and/or configurations. At least one blister 126 is dimensioned to hold at least one item 125. In one non-limiting example, a thermoforming technique may be used to fabricate a plastic shell containing one or more blisters 126. The blister pack 128 includes a lidding film 127 generally comprising a foil, aluminum, plastic or paper layer. The lidding film is secured to the underside of the blister pack 128 for securely holding at least one item 125 within at least one blister 126. The lidding film is operable to rupture or otherwise release item 125 upon application of pressure to blister 126. The blister pack 128 may be formed from a plastic, cardboard, paper, or paperboard material or any combination thereof.

In the exemplary embodiment, the panels are integrally formed as one piece. However, the panels may comprise separate and distinct pieces that are separately attached together. Again, a tear-resistant layer may or may not be adhered to the blank 101. The tear-resistant layer can be attached to face panel 112, with or without covering apertures 124, or to the back panel 114. If desired, a tear-resistant layer can also be attached to the first cover panel 116 or second cover panel 118 also increasing the structural integrity and strength of the package.

Although tabs and openings in the blank are shown in particular shapes, it will be noted that other shapes may be used without departing from the scope of the invention.

An exemplary method of manufacturing the above described blank 101 comprises combining certain cuts and making those cuts in one pass. Here, with the unprinted side facing a knife or die, partial-depth cuts may be substituted with a crease, score, or similar foldable line of joinder. Thereafter, the full-depth cuts, partial-depth cut, and cut or foldable lines 136 may all be made in the same pass.

As illustrated, the child-resistant package of the present invention includes a variety of security features. Initially, force is applied to press a tab out of plane of face panel 112 and back panel 114. Subsequently, the tab must be pulled to slide a slide tab out from the package to open the area beneath the blister. Finally, pressure is applied to the blister 126 to force an item 125 to rupture the lidding film 127 of the blister pack 128 and to optionally dislodge a gate 144A thereby releasing item 125.

The invention increases child-resistance capability while still providing a senior-friendly package. The invention contemplates that the degree of child resistance can be varied in direct proportion to the depths of various partial-depth cuts or the number and size of nicks left in the cuts.

Alternative exemplary embodiments of the present invention include methods of packaging items or products within a child-resistant package 105. One method includes the steps of constructing a package blank 101 having a face panel 112 and a back panel 114. The method further includes the steps of forming at least one face tab 132 and at least one aperture 124 on the face panel 112, the aperture 124 correspondingly aligning with face tab 132. The method further includes the steps of forming, on the back panel 114, at least one gate 144.

The method further includes the steps of positioning a blister pack 128 on the back panel 114 wherein at least one blister 126 aligns with a gate 144. The method further includes sealing the face panel 112 and the back panel 114 for securely enclosing blister pack 128 and a slide tab 164, where at least one blister 126 protrudes through a corresponding aperture 124 and wherein face tab 132 is sealed to back tab 138 forming push tab, and wherein the slide tab 164 is positioned between the blister 126 and the gate 144 until the slide tab 164 is slidably removed by a user.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many combinations and variations of combinations may be made to the above-described embodiments without departing from the scope of the claims. All such combinations and variations of combinations are included herein by the scope of this disclosure and the following claims.

The invention claimed is:

1. A blank for forming a package for use with a blister pack, the blank comprising:

a back panel comprising at least one gate formed in the back panel;

a face panel hingedly attached to the back panel along a first fold line, the face panel comprising:

at least one blister aperture; and at least one removable face tab, the at least one removable face tab being at least partially severable from the face panel and corresponding to the at least one aperture;

an auxiliary panel hingedly attached to one of the face panel and the back panel along a second fold line, the auxiliary panel comprising:

at least one removable slide pull attached to a slide tab, the at least one removable slide pull and slide tab each severable from the auxiliary panel;

wherein when the auxiliary panel is folded into facing contact with the one of the face panel and the back panel along the second fold line, and the face panel is folded onto the back panel along the first fold line, the auxiliary panel is positioned between the face panel and back panel, and the at least one gate, the at least one blister aperture, and the slide tab are located in registry with one another.

2. The blank of claim 1, wherein the at least one gate formed in the back panel is a cut-out opening.

3. The blank of claim 1, wherein the at least one gate formed in the back panel is a covered area delineated by perforations or cuts.

4. The blank of claim 1, wherein the at least one removable face tab is completely severable from the face panel.

5. The blank of claim 1, wherein the at least one removable face tab is completely severable from the face panel, and operates with the at least one removable slide pull to facilitate grasping of the slide tab.

6. A child-resistant blister package comprising:

a back panel comprising at least one gate formed in the back panel;

a face panel comprising:

at least one blister aperture; and at least one removable face tab, the at least one removable face tab being at least partially severable from the face panel and corresponding to the at least one aperture;

an auxiliary panel positioned between the back panel and face panel, the auxiliary panel comprising at least one removable slide pull attached to a slide tab, the at least one removable slide pull and slide tab each severable from the auxiliary panel;

a blister pack comprising at least one blister and at least one corresponding blister opening, the blister pack positioned between the auxiliary panel and the face panel, with the at least one blister extending through the at least one blister aperture;

wherein the at least one gate, the slide tab, the at least one blister aperture, and the at least one blister are located in registry with one another.

7. The child-resistant blister package of claim 6, wherein the at least one gate formed in the back panel is a cut-out opening.

8. The child-resistant blister package of claim 7, wherein the at least one gate formed in the back panel is a covered area delineated by perforations or cuts.

9. The child-resistant blister package of claim 6, wherein the at least one removable face tab is completely severable from the face panel.

10. The child-resistant blister package of claim 6, wherein the at least one removable face tab is completely severable from the face panel, and operates with the at least one removable slide pull to facilitate grasping of the slide tab.

11. The child-resistant package of claim 6, wherein a pulling force on the at least one removable slide pull withdraws the slide tab from between the face panel and back panel.

12. The child-resistant blister package of claim 6, wherein the back panel and the face panel are foldably adjoined to one another.

13. A method of forming a child-resistant package, the method comprising:

providing a back panel comprising at least one gate formed in the back panel;

providing a face panel comprising:

at least one blister aperture; and at least one removable face tab, the at least one removable face tab being at least partially severable from the face panel and corresponding to the at least one aperture;

providing an auxiliary panel comprising at least one removable slide pull attached to a slide tab, the at least one removable slide pull and slide tab each severable from the auxiliary panel;

positioning the auxiliary panel between the back panel and face panel;

providing a blister pack comprising at least one blister and at least one corresponding blister opening positioning the blister pack between the auxiliary panel and the face panel, with the at least one blister extending through the at least one blister aperture;

wherein the at least one gate, the slide tab, the at least one blister aperture, and the at least one blister are located in registry with one another.

14. The method of claim 13, wherein the at least one gate formed in the back panel is a cut-out opening.

15. The method of claim 13, wherein the at least one gate formed in the back panel is a covered area delineated by perforations or cuts.

16. The method of claim 13, wherein the at least one removable face tab is completely severable from the face panel.

17. The method of claim 13, wherein the at least one removable face tab is completely severable from the face panel, and operates with the at least one removable slide pull to facilitate grasping of the slide tab.

18. The method of claim 13, wherein a pulling force on the at least one removable slide pull withdraws the slide tab from between the face panel and back panel.

19. The method of claim 13, wherein the back panel and the face panel are foldably adjoined to one another.

* * * * *